United States Patent [19]

Ghosh

[11] Patent Number: 4,721,537

[45] Date of Patent: Jan. 26, 1988

[54] METHOD OF PRODUCING A FINE GRAIN ALUMINUM ALLOY USING THREE AXES DEFORMATION

[75] Inventor: Amit K. Ghosh, Thousand Oaks, Calif.

[73] Assignee: Rockwell International Corporation, El Segundo, Calif.

[21] Appl. No.: 787,201

[22] Filed: Oct. 15, 1985

[51] Int. Cl.[4] ..... C22F 1/04

[52] U.S. Cl. ..... 148/12.7 A; 148/415; 148/416; 148/417; 420/902

[58] Field of Search ..... 148/11.5 A, 12.7 A, 148/2, 415–418; 420/902

[56] References Cited

U.S. PATENT DOCUMENTS 4,092,181 5/1978 Paton et al. ..... 148/12.7 A

*Primary Examiner*—R. Dean

*Attorney, Agent, or Firm*—H. Fredrick Hamann; Craig O. Malin

[57] ABSTRACT

A method is provided for imparting a very fine grain size to aluminum alloys, including alloys in the form of sheet or heavy sections such as forging billets. The alloy is first aged to form precipitates. The aged alloy is then deformed along its three principal axes in successive operations until a cummulative true strain of at least 8 is achieved.

11 Claims, 5 Drawing Figures

Fig.1.
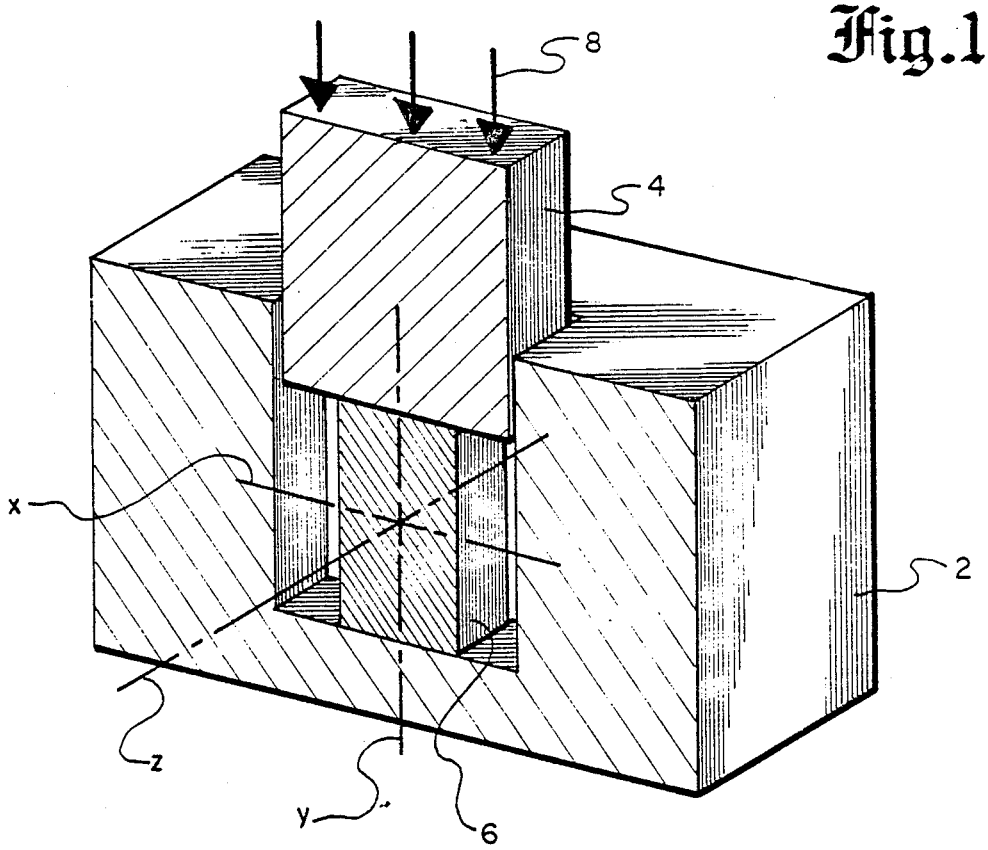
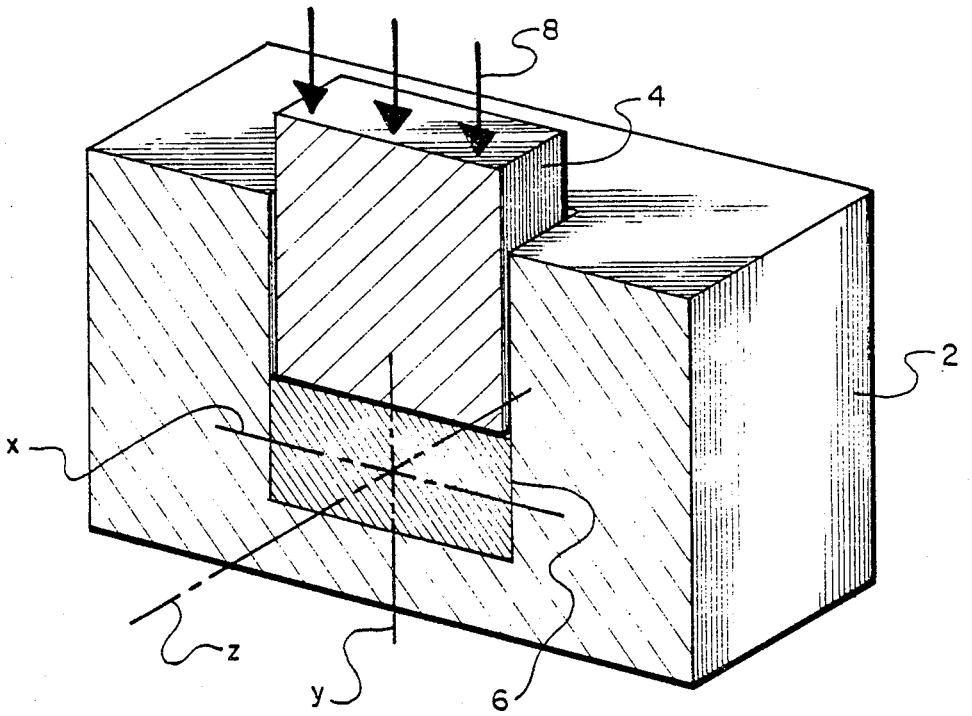
Fig.2.

GRAIN SIZE ~ 4 μm

GRAIN SIZE ~ 3 μm

METHOD OF PRODUCING A FINE GRAIN ALUMINUM ALLOY USING THREE AXES DEFORMATION

BACKGROUND OF THE INVENTION

This invention rlates to the field of metallurgy, and particularly to the field of processing aluminum alloys which have precipitating and dispersoid forming constituents.

Fine grain aluminum alloys have been produced by a three step, thermo-mechanical process (overaging, deformation, and recrystallization) such as described in U.S. Pat. No. 4,092,181. This prior art process and later modifications such as described in U.S. Pat. Nos. 4,222,797; 4,295,901; 4,358,324; 4,490,188; 4,486,242; and 4,486,244 have produced grains as small as 8 μm in thin sheet material. The fine grain material has good ductility and is capable of being superplastically formed. Although the prior art process has proven very useful for fabricating fine grain sheet, the large amount of deformation required has presented a problem in obtaining fine grain in heavy sections such as heavy plate, bar, and forging stock. Additionally, prior attempts to provide ultrafine grain size (about 2 μm) have not been successful.

SUMMARY OF THE INVENTION

It is an object of the invention to provide a fine grain structure in heavy sections of aluminum alloy such as plate, bar, and forging stock.

It is an object of the invention to provide aluminum alloys with a very fine grain structure.

According to the invention, a billet of the alloy is solution treated and aged to produce precipitates within the material. In certain cases the material could be overaged and, in other cases, it could be peak aged.

The aged billet is then hot deformed along its three principal axes (x, y, z) in successive cycles until a true strain of at least 8.0 (engineering strain approximately 3000%) is achieved. This three-axes deformation is accomplished by pressing a billet along its y axis while restraining its motion along its z axis, causing the billet to elongate in the unrestrained direction along its x axis. After about 100% deformation (true strain=0.69), the billet is rotated and then pressed along its elongated x axis, and allowed to elongate a second time along its z axis (the axis which was previously restrained). The billet is rotated a second time and pressed along its z axis which was just previously elongated, while allowing it to elongate along its y axis. These three operations complete the first cycle, and they produce a billet which has been deformed along three axes, but still retains its original shape.

Second, third, and more cycles are used as necessary to achieve a total deformation sufficient to provide the desired small grain size. This requires a cummulative true strain of about 8.0 or more.

The hot deformation is done at a temperature at which simultaneous precipitation and dynamic recovery can occur. The processed billet, which develops an ultrafine grain size, is extremely soft at elevated temperatures and in an ideal condition for precision forging or for reduction to fine grain plate or sheet by rolling.

BRIEF DESCRIPTION OF THE DRAWINGS

FIG. 1 is a perspective cross-sectional view of a billet and forging die used to illustrate the beginning of the first stage in the three-axes forging method of the invention;

FIG. 2 shows the billet and forging die of FIG. 1 at the end of the first stage in the three-axes forging method;

DESCRIPTION OF THE PREFERRED EMBODIMENT

Figure 3:
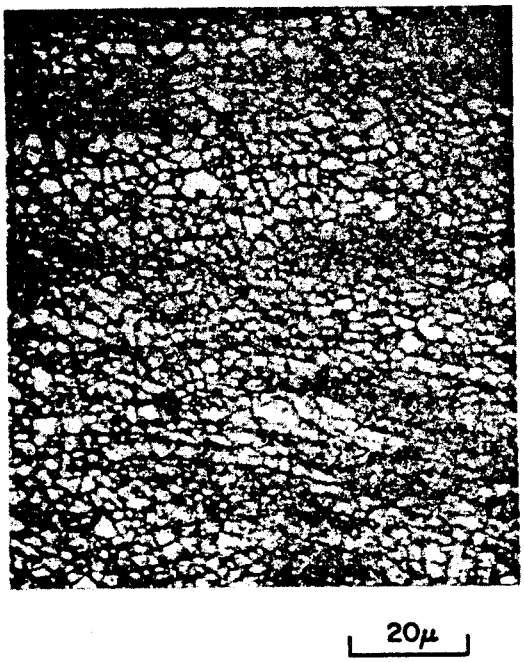
FIG. 3 shows the microstructure obtained in 7075 aluminum alloy after processing per Example 1 of the invention.

According to the invention, large amounts of shear deformation are imparted to a dispersoid-containing aluminum alloy in the temperature range where simultaneous precipitation and dynamic recovery can occur. Precipitation during deformation pins the dislocation so introduced, and simultaneous dynamic recovery (a process of dislocation annihilation and rearrangement) allows the development of a network of sub-grain boundaries. With continued deformation, the sub-grain size gets smaller until a steady size is reached depending on the alloy type and chemistry. During this process, the subgrain misorientation also increases to form a well recrystallized fine grain structure.

Dispersoids are needed in the alloy in order to pin the grain boundaries and to maintain the alloy's stability at elevated temperatures. The dispersoids are particles found in many aluminum alloys such as in 7000 series alloys and in aluminum-lithium alloys which are not substantially changed by normal solution and aging treatments. They are high temperature constituents such as Cr-, Mn-, Zr-, and Co-containing intermetallics distributed in a very fine form.

In order to obtain large amounts of deformation without excessively thinning the material, a billet of material is repeatedly cycled through a three-axes forging process. By using three-axes forging, the material can be deformed without changing the configuration of the original forging billet.

The process can be applied to a wide range of aluminum alloys having precipitating and dispersoid forming constituents, including alloys made by conventional casting and working, and alloys made by powder metallurgy techniques.

A billet of material to be processed is first aged to form precipitates within its microstructure. The material can be peak aged (aged at a time and temperature in order to give optimum strength), or overaged (aged for longer times or at higher temperatures than peak aging).

After aging, the material in the form of a billet is deformed or forged at a temperature at which simultaneous precipitation and dynamic recovery can occur, namely in the range of 200° C. to 400° C. (425° F. to 752° F.). This deformation temperature is below the normal forging temperature of 380° C.–480° C. (720° F.–900° F.), but is no lower than the normal peak aging temperature for aluminum alloys of 115° C.–220° C. (240° F. to 425° F.). The actual temperature used depends upon the particular alloy being treated. For example, the aluminum-lithium type alloys can be aged at 120° C.–400° C. (248° F.–752° F.) and then deformed at 240° C.–390° C. (464° F.–735° F.).

In order to obtain sufficient deformation (a true strain of at least 8), a special multi-step three-axes forging or pressing process is used. A 2:1 compressive reduction is imparted to a tetragonal billet in one axial direction during one step. Then the orientation of the billet is changed and an additional 2:1 reduction is imparted to the billet in another axial direction. These steps are repeated so that large overall strains are imparted to the billet without causing strain localization in any given pass, and without changing the overall configuration of the billet. Even though deformation is inhomogeneous in each single step, deformation homogeneity results in the course of the multipass forging operation in each axial direction. Such a three-axes forging technique is readily implemented in production forging presses, with automated billet handling and side-restraining capabilities.

For laboratory work and for purposes of illustrating the invention, a special die 2 and ram 4 were used to forge a small tetragonal billet 6 of aluminum alloy as shown in FIG. 1. The height of the billet along its y axis is greater than 1.5 times its dimension along either of its x or z dimensions. These three axes x, y, and z are at right angles to each other and are called the principal axes of the billet. In the first stage of a forging cycle, pressure 8 is applied to ram 4. The walls of die 2 confine billet 6 in the z direction so that billet 6 deforms only in the x direction. This result is shown in FIG. 2 with ram 4 in its position at the end of the first stage in the cycle. Billet 6 is now elongated along its x direction, although its overall configuration is the same as it was at the beginning of the first stage (FIG. 1).

In the second stage of the cycle, billet 6 is turned so that its x axis is vertical and its y axis is restrained by the walls of die 2. The assembly is now smilar to FIG. 1 except that the orientation of the axes has been changed as described above. Pressure 8 is applied and billet 6 elongates along its z axis. The three-stage cycle is completed by turning billet 6 again so that its elongated z axis is vertical and the material is free to elongate only along its y directions.

The three-stage cycle is repeated as many times as necessary to provide a cummulative true strain that is sufficient to provide the desired fine grain. The required strain for a particular alloy and grain size can readily be determined empirically. Cummulative true strains of 12 to 14 have provided fine grain material, and for many materials a cummulative true strain as low as 8–10 should provide grain refinement.

Examples of the method of the invention used to form a 38 mm×19 mm×19 mm billet are given below. In all the examples, a die and ram such as shown in FIGS. 1 and 2 were used for the three-axes forming.

EXAMPLE 1

7075 Aluminum Alloy

A 38 mm×19 mm×19 mm block of 7075 aluminum alloy (with a grain size of approximately 100 μm) was solution treated at 482° C. (900° F.) and peak aged at 121° C. (250° F.) for 24 hours. The block was three-axes deformed as described above in 15 stages (5 complete cycles) by reducing the 38 mm dimension to 19 mm in each stage to provide a cummulative true strain of 12. Temperature during deformation was 300° C. (572° F.). After the fifteenth stage, the block was solution-treated at 482° C. (900° F.) for 30 minutes to complete the process of recrystallization, and to dissolve the precipitates so that a clean micrograph could be obtained to reveal the grain structure. A grain size of 4–5 μm was obtained as shown in FIG. 3.

EXAMPLE 2

P/M Alloy, 7.2 Zn, 2.2 Cu, 2.5 Mg, 1.5 Cr, 0.22 Zr, 0.25 Co, Balance Al

Figure 4:
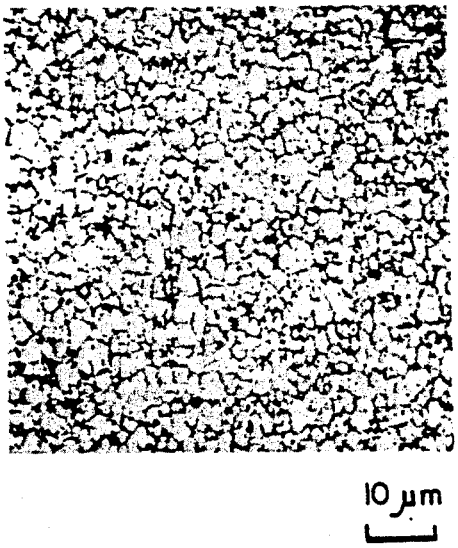
FIG. 4 shows the microstructure obtained in a powder metallurgy alloy after processing per Example 2 of the invention.

A 38 mm×19 mm×19 mm block of a powder metallurgy (P/M) alloy was solution treated at 482° C. (900° F.) and overaged at 350° C. (662° F.). The block was then three-axes forged at 250° C. (482° F.) as described for Example 1 except that the cummulative true strain was 14. Grain size of the as-forged block was approximately 3 μm as shown in FIG. 4.

EXAMPLE 3

P/M Alloy, 7 Zn, 2.4 Mg, 1.93 Cu, 0.31 Zr, Balance Al

A block of powder metallurgy aluminum alloy in the as-extruded condition (in-between peak and overaged conditions) was forged as described above for Example 2 except that the forging temperature was 280° C. (536° F.). After forging, this block had a grain size of 3.5 μm.

EXAMPLE 4

Aluminum-Lithium Alloy, 2.95 Li, 1.83 Cu, 0.5 Mg, 0.19 Zr, Balance Al

A block of aluminum-lithium alloy was solution treated at 500° C. (932° F.) and overaged at 360° C. (680° F.). The block was then three-axes forged at 280° C. (536° F.) for a cummulative true strain of 14 as described for Example 2. After forging, this block had a grain size of 3 μm.

EXAMPLE 5

5.8 Zn, 2.3 Mg, 1.5 Cu, 0.2 Zr, Balance Al

A block of aluminum alloy (produced via ingot route) was overaged, and three-axes forged as described in Example 2 except that a forging temperature of 270° C. (518° F.) was used. The grain size after forging was 2.5 μm.

The above five examples are summarized in Table I. In all cases, a very fine grain size of 3–5 μm was obtained. Because grain volume is proportional to the cube of the grain size, this invention represents a large improvement over the previously smallest obtainable grain size of 8 μm.

TABLE I

SUMMARY OF EXAMPLES

| | EXAMPLE NO. | | | | |
|---|---|---|---|---|---|
| STEP | 1 7075 Alloy | 2 P/M Alloy | 3 P/M Alloy | 4 Al—Li Alloy | 5 Alloy |
| Solution Treat | 482° C. | 482° C. | 482° C. | 500° C. | 482° C. |
| Age | 121° C. | 350° C. | 350° C. | 360° C. | 350° C. |
| 3-Axes Forging | | | | | |
| Temperature | 300° C. | 250° C. | 280° C. | 280° C. | 270° C. |
| Strain | 12 | 14 | 14 | 14 | 14 |
| Post Treatment | 482° C. for 30 min | 482° C. for 30 min | 482° C. for 30 min | 482° C. for 30 min | 482° C. for 30 min |
| Grain Size | 4–5 um | 3 um | 3.5 um | 3 um | 2.5 um |

The billet processed according to the invention is extremely soft at elevated temperature and is ideal for isothermal forging or for subsequent reduction to sheet or plate. The extremely fine grain size permits superplastic forming at lower temperatures or at higher forming rates with the attainment of significantly greater degree of superplasticity than previously possible.

Figure 5:
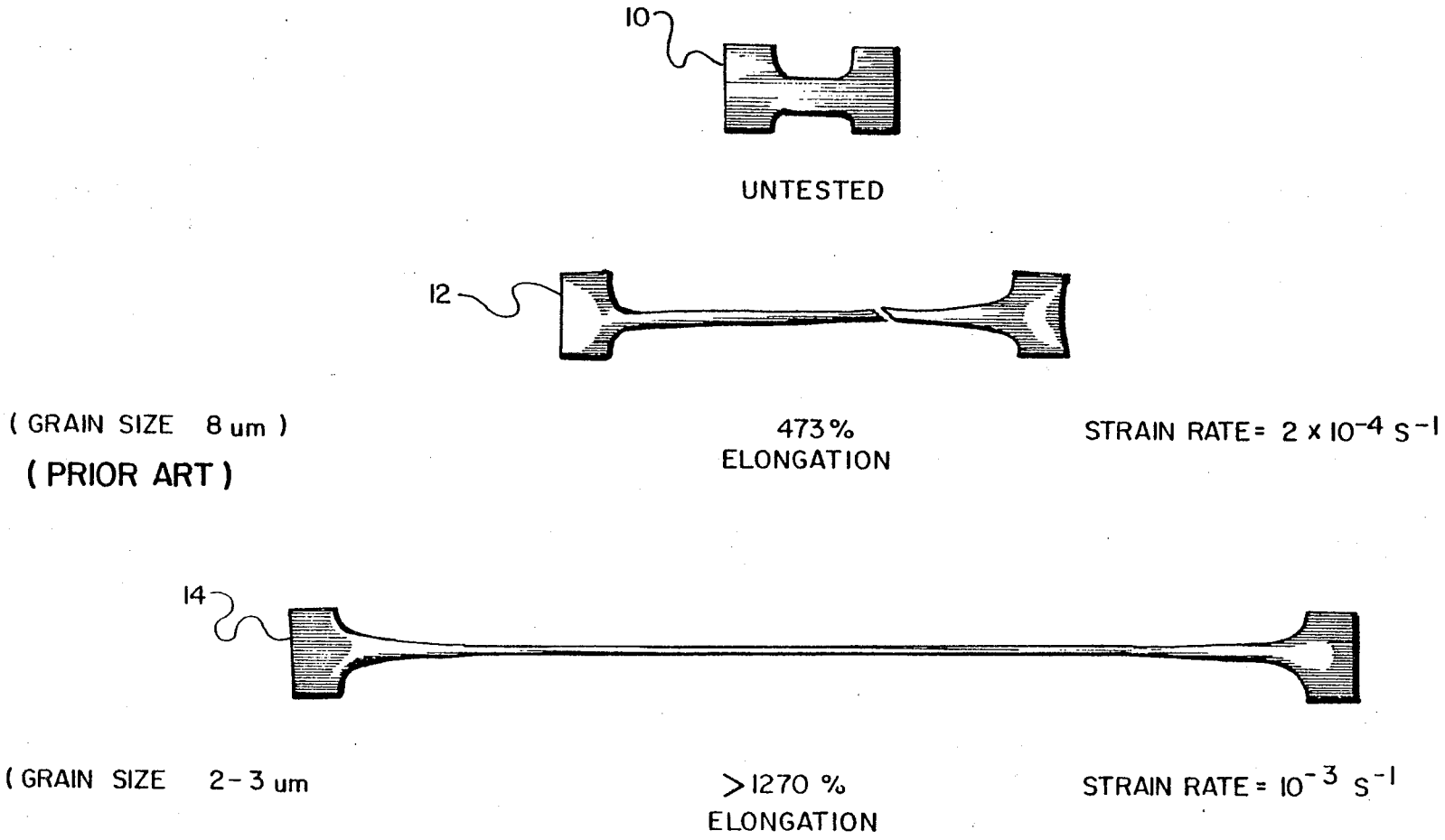
FIG. 5 shows tensile bars used to compare the superplastic formability of fine grain aluminum produced according to the invention with fine grain aluminum produced according to the prior art.

FIG. 5 shows the results of superplastic testing fine grain aluminum alloy (5.8 Zn, 2.3 Mg, 1.5 Cu, 0.2 Zr). Bar 10 is an example of a tensile test bar before testing. Bar 12 is a test bar which was tensile tested under optimum superplastic conditions using a strain rate of $2\times10^{-4}s^{-1}$. It was fabricated by the prior art thermomechanical process, and had a grain size of approximatey 8 μm. Total elongation of bar 12 at failure was 473%.

Bar 14 is a test bar which was tested under optimum superplastic conditions using a strain rate of $1\times10^{-3}s^{-1}$. It was fabricated from the same aluminum alloy as bar 12, but it was processed according to Example 5 of the invention and then rolled into sheet. It had a grain size of 2–3 μm. Total elongation of bar 14 was over 1270%.

Numerous variations and modifications can be made without departing from the present invention. Optimum temperatures for particular materials and available forging equipment can be determined empirically. Likewise the amount of strain provided at each stage, the number of cycles used, and the cummulative strain can be varied to provide the most economical process for particular applications. The size and shape of the billet can be selected as required for the end product and to most economically utilize the forge or press which is available. Accordingly, it should be understood that the form of the invention described above is illustrative and is not intended to limit the scope of the invention.

What is claimed is:

1. A method of reducing the recrystallized grain size of a precipitation hardening aluminum alloy having fine dispersoids comprising the steps of:
   forming precipitates in said alloy;
   deforming said alloy within a temperature range at which simultaneous precipitation and dynamic recovery occur, and along each of its three principal axes in consecutive, successive stages for a cummulative true strain sufficient to provide a grain size of about 5 μm or less; and
   cooling said alloy.

2. The method as claimed in claim 1 wherein said deformed alloy is heated to a recrystallization temperature to recrystallize any uncrystallized grains in said alloy.

3. The method as claimed in claim 1, wherein said step of forming precipitates in said alloy comprises:
   solution treating said alloy; and
   peak aging said alloy.

4. The method as claimed in claim 1 wherein said step of forming precipitates in said alloy comprises:
   solution treating said alloy; and
   overaging said alloy.

5. The method as claimed in claim 1 wherein said deforming step comprises deforming said alloy along each principal axis in consecutive, successive stages of 2:1 compressive reduction until a true strain of at least 8 is achieved.

6. The method as claimed in claim 1 wherein said deforming step is done within a temperature range of from about 220° C. to 400° C. (425° F. to 752° F.).

7. The method as claimed in claim 1 wherein said cummulative true strain is at least about 12.

8. A method of reducing the grain size of a 7000 series aluminum alloy comprising the steps of:
   solution treating said alloy;
   aging said alloy within the temperature range of about 115° C. to 435° C. (240° F. to 820° F.);
   deforming said alloy within a temperature range of about 220° C. to 370° C. (425° F. to 700° F.) along each of its three principal axes in consecutive, successive stages for a cumulative true strain of at least about 12; and
   cooling said alloy.

9. A method of reducing the grain size of an Al-Li alloy comprising the steps of:
   solution treating said alloy;
   aging said alloy within the temperature range of about 120° C. to 400° C. (248° F. to 752° F.);
   deforming said alloy within a temperature range of about 240° C. to 390° C. (464° F. to 735° F.) along each of its three principal axes in consecutive, successive stages for a cummulative true strain of at least about 12; and
   cooling said alloy.

10. A method of reducing the grain size of an extrudable aluminum alloy having fine dispersoids, which has been extruded under conditions which leave the as-extruded material between peak and overaged conditions, comprising the steps of:
   deforming said extruded aluminum alloy within a temperature range at which simultaneous precipitation and dynamic recovery occur, and along each of its three principal axes in consecutive successive stages for a cumulative true strain sufficient to provide a grain size of about 5 μm or less; and
   cooling said alloy.

11. A precipitation hardening aluminum alloy having a grain size of about 5 μm or less and produced by three axes deformation in accordance with the method of claim 1.

* * * * *